US011486155B2

(12) United States Patent
Hamano et al.

(10) Patent No.: US 11,486,155 B2
(45) Date of Patent: Nov. 1, 2022

(54) BINDING MACHINE

(71) Applicant: MAX CO., LTD., Tokyo (JP)

(72) Inventors: Terufumi Hamano, Tokyo (JP); Makoto Kosuge, Tokyo (JP); Shinpei Sugihara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 68 days.

(21) Appl. No.: 16/276,754

(22) Filed: Feb. 15, 2019

(65) Prior Publication Data

US 2019/0257098 A1 Aug. 22, 2019

(30) Foreign Application Priority Data

Feb. 16, 2018 (JP) ..... JP2018-025864

(51) Int. Cl.
*E04G 21/12* (2006.01)
*B21F 15/04* (2006.01)
*E04G 21/16* (2006.01)

(52) U.S. Cl.
CPC ..... *E04G 21/123* (2013.01); *B21F 15/04* (2013.01); *E04G 21/16* (2013.01)

(58) Field of Classification Search
CPC ..... E04G 21/123; E04G 21/16; E04G 21/122; B21F 15/04; B21F 7/00; B65B 13/28; B65B 13/285; B65B 13/00; B65B 25/00
USPC ..... 140/118
See application file for complete search history.

(56) References Cited

U.S. PATENT DOCUMENTS 9,004,114 B2 * 4/2015 Kasahara ..... E04G 21/122 140/93.6
2007/0246237 A1 10/2007 Homsi et al.
2009/0090428 A1 4/2009 Kasahara et al.
2012/0214640 A1 8/2012 Saur
2015/0176295 A1 6/2015 Kasahara et al.
2017/0218631 A1 * 8/2017 Matsuno ..... E04C 5/166
(Continued)

FOREIGN PATENT DOCUMENTS

EP 1 900 640 A1 3/2008
JP 2007-8562 A 1/2007
(Continued)

OTHER PUBLICATIONS

Translation of JP 2009274195 A (Year: 2009).*
European Search Report issued in Application No. 19157471.4, dated Jul. 11, 2019, 7 pages.

*Primary Examiner* — Shelley M Self
*Assistant Examiner* — Teresa A Guthrie
(74) *Attorney, Agent, or Firm* — Weihrouch IP

(57) ABSTRACT

A binding machine includes: a twisting unit configured to twist a binding member which is guided in a loop shape so as to wrap around an object, and thus to bind the object; a twist motor configured to drive the twisting unit; a circuit board having a mounting surface on which a control unit configured to control the twist motor is mounted; a body portion housing the twisting unit, the twist motor and the circuit board; and a handle portion protruding outward from the body portion. The circuit board is arranged between the twist motor and an inner wall surface of the body portion which is located toward the handle portion in such a manner that the mounting surface faces the inner wall surface and the circuit board is closer to the twist motor than the inner wall surface.

12 Claims, 11 Drawing Sheets

(56) References Cited

U.S. PATENT DOCUMENTS

| | | | | |
|---|---|---|---|---|
| 2017/0335582 | A1 | 11/2017 | Machida et al. | |
| 2019/0193879 | A1* | 6/2019 | Yamamoto | B65B 13/22 |
| 2020/0270881 | A1 | 8/2020 | Machida et al. | |

FOREIGN PATENT DOCUMENTS

| | | | | |
|---|---|---|---|---|
| JP | 2009-274195 | A | | 11/2009 |
| JP | 2009274195 | A | * | 11/2009 |
| JP | 2017-132003 | A | | 8/2017 |
| JP | 2017-206302 | A | | 11/2017 |

* cited by examiner

BINDING MACHINE

CROSS-REFERENCE TO RELATED APPLICATION

This application claims priorities from Japanese patent application No. 2018-025864 filed on Feb. 16, 2018, the entire contents of which are incorporated herein by reference.

TECHNICAL FIELD

The technology disclosed herein relates to a binding machine.

BACKGROUND

For example, a binding machine is used to bind an object, such as reinforcing bars, at a construction site and the like (see Patent Document 1). By using the binding machine, the work can be reliably speeded up. Thus, it is expected that the binding machine will come into wide use in the future.

Patent Document 1: Japanese Patent Application Publication No. 2017-132003

SUMMARY

Since the binding machine can be operated with one hand, usability is very good, but if the work is performed for a long time, a burden on a worker's arm increases. Therefore, in order to alleviate the burden on the worker's arm at least a little bit, a study for improving a weight balance of the binding machine is required. Accordingly, an object of the technology disclosed herein is mainly to improve the weight balance of the binding machine.

In order to solve the problem, a binding machine of the present disclosure includes: a twisting unit configured to twist a binding member which is guided in a loop shape so as to wrap around an object, and thus to bind the object; a twist motor configured to drive the twisting unit; a circuit board having a mounting surface on which a control unit configured to control the twist motor is mounted; a body portion housing the twisting unit, the twist motor and the circuit board; and a handle portion protruding outward from the body portion, wherein the circuit board is arranged between the twist motor and an inner wall surface of the body portion which is located toward the handle portion in such a manner that the mounting surface faces the inner wall surface and the circuit board is closer to the twist motor than the inner wall surface.

According to the binding machine, the circuit board is arranged between the twist motor and the inner wall surface of the body portion, which faces the handle portion, and also the mounting surface is arranged to face the inner wall surface of the body portion, i.e., away from the twist motor. Also, since the mounting surface faces away from the twist motor, the circuit board is arranged to be closer to the twist motor. Further, since the circuit board is arranged to be closer to the twist motor, a grip can be brought closer to the center of the body portion, thereby improving the weight balance of the binding machine.

DETAILED DESCRIPTION

Hereinafter, the present embodiment will be described in detail with reference to the accompanying drawings. FIGS. 1 to 11 are intended to describe the present embodiment.

Embodiment 1

<Configuration>

Hereinafter, a configuration of the present embodiment will be described.

Figure 1:
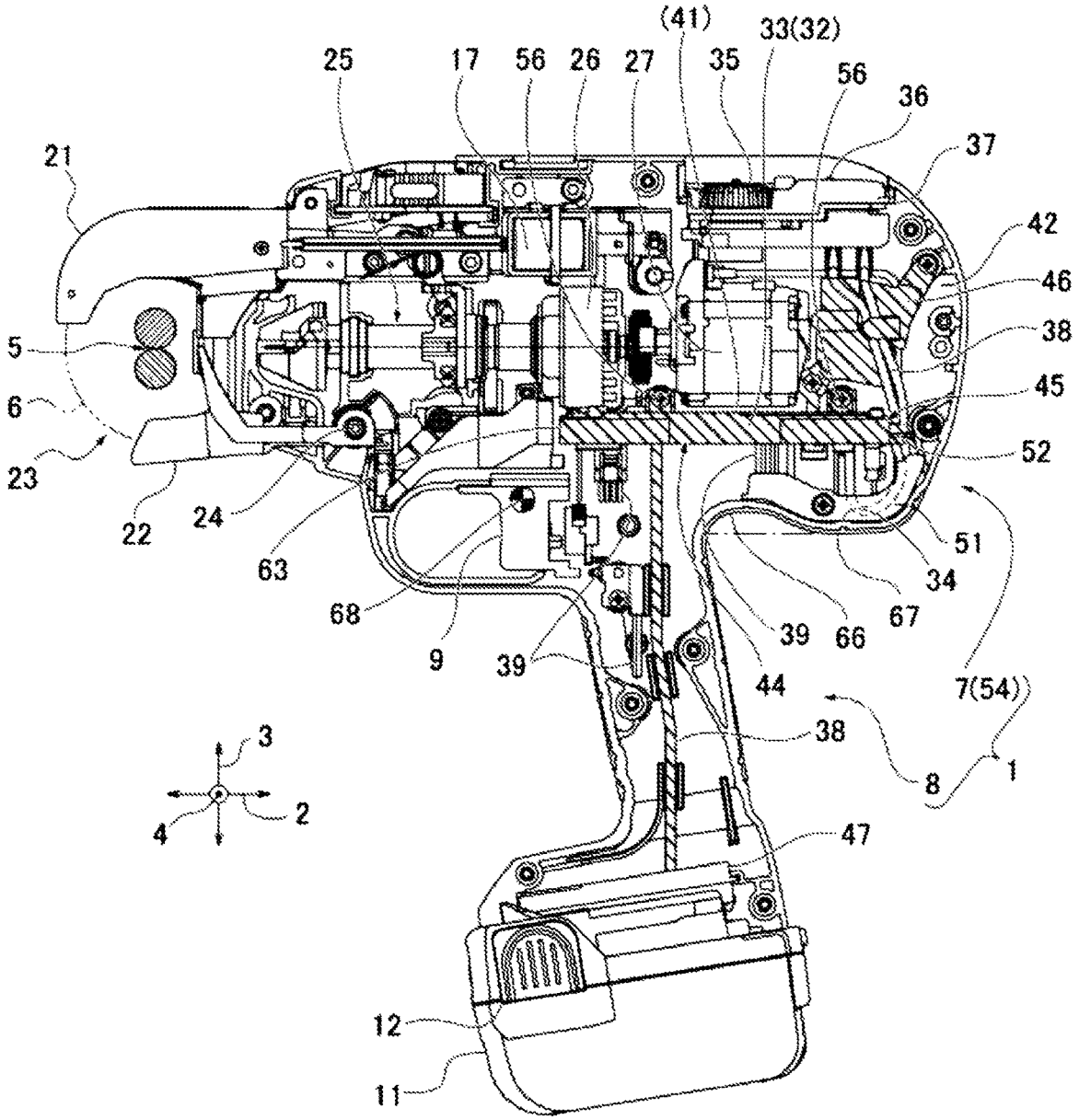
FIG. 1 is a view showing an interior structure of a binding machine according to the present embodiment, as viewed from the side.

FIG. 1 (to FIG. 4) shows a binding machine 1. Three arrows in the figures represent, respectively, a first direction 2 corresponding to a horizontal direction of the binding machine 1, a second direction 3 perpendicular to the first direction 2 and also corresponding to a vertical direction of the binding machine 1, and a third direction 4 perpendicular to the first direction 2 and the second direction 3 and also corresponding to a widthwise direction of the binding machine 1.

The binding machine 1 is an electric power tool intended to bind an object 5, such as reinforcing bars, with a binding member 6, such as a wire. The binding machine 1 includes a twisting unit 25 configured to twist a binding member 6, which is guided in a loop shape to wrap around an object 5, and thus to bind the object 5; a twist motor 27 for driving the twisting unit 25; a circuit board 32 having a mounting surface 32*a* (FIG. 3), on which a control unit 40 (FIG. 3) for controlling the twist motor 27 is mounted; and a body portion 7 for housing the twisting unit 25, the twist motor 27 and the circuit board 32. A handle portion 8 extending outward, i.e., substantially in the second direction 3, is provided on the substantially middle part of the body portion 7 in the first direction 2. The body portion 7 has a generally hollow case extending in the first direction 2. In the following, reinforcing bars as the object 5 and a wire as the binding member 6 will be described by way of example. Also, in the first direction 2, a side of the body portion 7 facing the reinforcing bars 5 is referred to a front side of the body portion 7, and the opposite side thereof is referred to as a rear side of the body portion 7. Further, in the second direction 3, a side of the body portion 7, on which the handle portion 8 is provided, is referred to as a lower side of the body portion 7, and the opposite side thereof is referred to as a upper side of the body portion 7. Meanwhile, it should be noted that the body portion 7 can be oriented in various directions depending on a working posture of the binding machine 1 and thus the front/rear sides and the upper/lower sides are relative. The third direction 4 is a direction corresponding to a left and right direction of a worker, who holds the binding machine 1, and is represented as a direction perpendicular to the paper surface of the figures (the far side is the right side and the near side is the left side).

The handle portion 8 is provided on the body portion 7 for the purpose of easily performing a work while holding the binding machine 1. Thus, in order to easily grip the handle portion 8, the handle portion 8 is attached on the body portion 7 at an angle slightly inclined toward the front side of the body portion 7 with respect to the second direction 3. The handle portion 8 is formed by a generally hollow member. In the following, a portion (upper end portion) of the handle portion 8 facing the body portion 7 is referred to as a base portion or root portion of the handle portion 8, and the opposite portion thereof (lower end portion) is referred to as a distal end portion of the handle portion 8. Electric components, such as a trigger switch 9 as an activation switch, are provided on a front side of the root portion of the handle portion 8. Also, a battery 11 as a power supply is detachably attached on the distal end portion of the handle portion 8 via a battery attaching portion 12. Then, the binding machine 1 is activated by pulling the trigger switch 9 in a state where the binding machine 1 is turned on.

The binding machine 1 is configured to bind the reinforcing bars 5 by twisting the wire 6, which is guided in a loop shape to wrap around the reinforcing bars 5. The wire 6 is consumables and thus the wire 6 wound around a reel 13 (see FIG. 2) can be used. The body portion 7 is provided, on the rear portion thereof, with a mount portion (reel mount portion) 14 allowing the reel 13 to be rotatably mounted thereon. The mount portion 14 is provided with a reel detection unit having electric components, such as a sensor capable of detecting an attached or detached state of the reel 13. The reel detection unit is attached on the body portion 7 while being mounted on a sub-board. The mount portion 14 is provided with a brake unit for regulating rotation of the reel 13. The brake unit is configured to brake rotation of the reel 13, for example, at a time when delivery of the wire 6 is ended. The brake unit has a driving unit such as a solenoid 17. The driving unit such as the solenoid 17 is attached on the substantially middle portion (an upper portion thereof) of the body portion 7. The wire 6 drawn out from the reel 13 mounted on the mount portion 14 is delivered to the front side of the body portion 7 by a wire feeding unit 18 (see FIG. 2). The wire feeding unit 18 is provided on the substantially middle portion of the body portion 7. The wire feeding unit 18 has a driving unit constructed by an electric motor, such as a feeding motor, and feeding gears driven by the feeding motor.

The body portion 7 is provided, on a front end portion thereof, with curl guides 21, 22 configured to curl the wire 6 and then to guide the wire 6 in a loop shape around the reinforcing bars 5. The wire 6 is guided by the curl guides 21, 22 in such a manner that the wire 6 is wrapped in one turn or a plurality of turns around the reinforcing bars 5. The curl guides 21, 22 are provided in a pair while having a gap therebetween in the vertical direction (second direction 3) of the binding machine 1. Since the reinforcing bars 5 have to be inserted between the pair of curl guides 21, 22, an opening portion (insertion portion) 23 is provided therebetween. The pair of curl guides 21, 22 are provided to have different lengths in such a manner that the upper side (curl guide 21) is longer and the lower side (curl guide 22) is shorter. The upper curl guide 21 is fixed (fixed curl guide). The lower curl guide 22 may be fixed or movable (movable curl guide). In the present embodiment, the lower curl guide 22 is attached on the body portion 7 to be pivotable in the vertical direction about a curl guide shaft 24 extending in the third direction 4.

The body portion 7 is provided with the twisting unit 25 configured to perform binding by twisting the loop-shaped wire 6 wound around the reinforcing bars 5 to reduce a diameter of the loop. The twisting unit 25 is formed in a generally shaft shape extending in the first direction 2. The twisting unit 25 is connected to the twist motor 27 via a speed reduction mechanism 26. Then, the twisting unit 25 is operated by rotationally driving the twist motor 27.

Various driving units installed in the binding machine 1, such as the feeding motor, the twist motor 27 and the solenoid 17, are sequentially controlled by the control unit 40. The control unit 40 is mounted on the circuit board 32 (control board or main board). The circuit board 32 is installed between the twist motor 27 inside the body portion 7 and an inner wall surface 34 thereof located toward the handle portion 8, while the circuit unit 40 is received in a circuit board case 33. The circuit board case 33 is formed as a shallow dish or flat box-shaped container having, on one face thereof, an opening portion allowing the circuit board 32 to be received therein (see FIGS. 5 to 7). As viewed in a plan view, the circuit board 32 has a generally quadrangular shape, and a shape of the circuit board case 33 in the plan view is generally similar to that of the circuit board 32. Also, the binding machine 1 is installed with a setting unit 35 capable of setting operation conditions of the binding machine 1, specifically operation conditions of various driving units, such as the feeding motor, the twist motor 27 and the solenoid 17. In the setting unit 35, the number of turns of the wire 6 wound around the reinforcing bars 5, an amount of torque of the twist motor 27 used to twist the wire 6 and the like can be set. The setting unit 35 is mounted on a switch board 37, together with electric components, such as a main power switch or main switch 36 for turning on and off the power supply. Also, various driving units, such as the feeding motor, the twist motor 27 and the solenoid 17; various circuit boards, such as the circuit board 32 (main board), the switch board 37 and the sub-board; and a battery board 47, which are installed in the binding machine 1, are connected to each other by wirings. The wirings include, for example, power supply wirings 38, signal wirings 39 and the like. The wirings, such as power supply wirings 38 and signal wirings 39, are routed inside the body portion 7.

With respect to the basis configuration as described above, the binding machine 1 of the present embodiment is configured as follows.

(1) The binding machine 1 includes a twisting unit 25 configured to twist a wire 6, which is guided in a loop shape to wrap around reinforcing bars 5, and thus to bind the reinforcing bars 5; a twist motor 27 for driving the twisting unit 25; a circuit board 32 having a mounting surface 32*a*, on which a control unit 40 for controlling the twist motor 27 is mounted; a body portion 7 for housing the twisting unit 25, the twist motor 27 and the circuit board 32; and a handle portion 8 protruding outward from the body portion 7. The circuit board 32 is arranged between the twist motor 27 and the inner wall surface 34 of the body portion 7, which is located toward the handle portion 8, in such a manner that the mounting surface 32*a* faces the inner wall surface 34 (see FIG. 3). Also, the circuit board 32 is arranged to be closer to the twist motor 27 than the inner wall surface 34.

Herein, the mounting surface 32*a* of the circuit board 32 is a surface of the circuit board 32, on which electric components are mounted (a front surface of the circuit board 32 in the case of one-side mounting). The phrase "the mounting surface 32*a* faces the inner wall surface 34" means that a so-called soldering surface corresponding to a back surface with respect to the mounting surface 32*a* faces the twist motor 27. The soldering surface is entirely covered with the circuit board case 33. In order to receive the circuit board 32, the circuit board case 33 is also arranged such that the opening portion thereof is oriented toward the lower side, i.e., the inner wall surface 34. The inner wall surface 34 of the body portion 7, which is located toward the handle portion 8, is an inner surface of a wall portion (bottom wall) constituting a lower portion or bottom portion of the body portion 7, and corresponds to the wall portion inner surface ranging from a rear end of the base portion of the handle portion 8 to the rear end portion of the body portion 7. The phrase "closer to the twist motor 27 than the inner wall surface 34" means that rather than at the middle position between the inner wall surface 34 and the lowest point of the twist motor 27, the circuit board 32 is positioned toward the twist motor 27 (on an upper side thereof). Alternatively, the middle position may be defined based on a position of an attaching shaft (curl guide shaft) 24 for the lower curl guide 22 in the vertical direction (second direction 3) in the figures. The circuit board 32 is preferably arranged at a height substantially equal to or higher than that of the curl guide shaft 24.

A heat resistant member, such as a heat resistant sheet 41 (see FIG. 1), may be interposed between the circuit board 32 and the twist motor 27 as required. The heat resistant sheet 41 can be installed by attaching rubber or resin on an upper surface of the circuit board case 33. In this way, by interposing the heat resistant member, such as the heat resistant sheet 41, between the circuit board 32 and the twist motor 27, it is possible to protect the circuit board 32 from heat generated by the twist motor 27. Also, since the heat resistant sheet 41 is formed of rubber, resin or the like, the effect thereof as a vibration-proof material can be anticipated.

Figure 5:
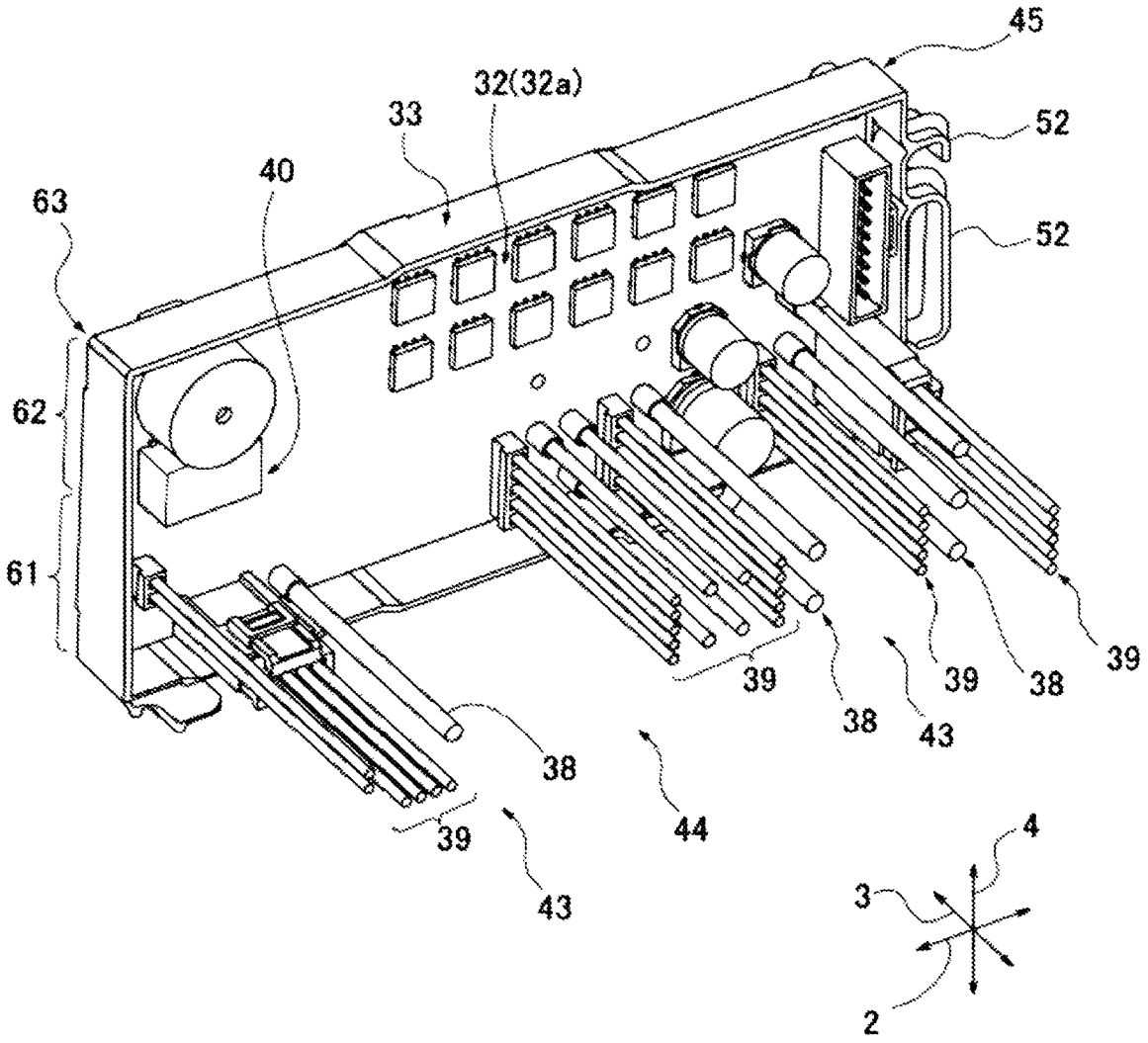
FIG. 5 is a perspective view of a circuit board in FIG. 3, as viewed obliquely from below.

(2) The circuit board 32 is provided at least between the twist motor 27 and the inner wall surface 34, but may extend further forward than the location, i.e., to a location opposing the handle portion 8. Also, the circuit board 32 may extend further rearward than the location opposing the twist motor 27, i.e., to a rear space 42 located on a side of the twist motor 27 opposite to the twisting unit 25. That is, the circuit board 32 may have an extending part which extends to a rear space 42 located on a side opposite to the twisting unit 25 with respect to the twist motor 27. In the present embodiment, the circuit board 32 extends from a location opposing the handle portion 8 to a location opposing the rear surface 42 as shown in FIG. 1. As shown in FIG. 5 (and also FIG. 6), the mounting surface 32*a* of the circuit board 32 is provided with a first region 43, on which wirings are concentrated, and a second region 44, on which wirings are not concentrated. The first region 43 may be arranged on at least a side of the circuit board 32 toward the rear space 42 (see FIG. 1). The power supply wirings 38 extending toward the main switch 36 for turning on and off the power supply are provided at least on the first region 43 and also may be arranged in a region of the circuit board 32 extending to the rear space 42, i.e., at a location on the mounting surface 32*a* of the circuit board 32 opposing the rear space 42.

Herein, the rear space 42 is formed between a rear end wall portion of the body portion 7 and a rear end portion of the twist motor 27. On the circuit board 32 and the circuit board case 33, a first extension portion 45 is provided to extend further rearward than a position of the rear end portion of the twist motor 27. A wiring receiving portion 46 for receiving a plurality of wirings and the like may be installed in a part of the rear space 42, which is located above the first extension portion 45. In this way, by providing the wiring receiving portion 46 in the rear space 42 and also straightening and receiving wirings into the wiring receiving portion 46, it is possible to shorten a wiring distance between the circuit board 32 and the twist motor 27 and also to cause the wirings to be supported in the wiring receiving portion 46. Herein, it is assumed that the phrase "concentrated" means a state where about 80% or more of the entire wirings extending from the circuit board 32 are gathered. It is assumed that the phrase "not concentrated" means a state where about 20% or less of the entire wirings extending from the circuit board 32 are sparsely arranged or no wirings are arranged. The first region 43 is not limited to a region of the circuit board 32, which is located toward the rear space 42, but may be provided on a front side of the circuit board 32, more specifically in front of the second region 44 and the like. In the present embodiment, the second region 44 is provided between two first regions 43, which are respectively located on front and rear sides of the circuit board 32. The front-side first region 43 and at least a part of the second region 44 are present generally at a location opposing the handle portion 8.

In the inside of the handle portion 8 (at the center position thereof), a wiring from the circuit board 32 (e.g., one of the power supply wirings 38) may be arranged to generally straightly extend therethrough. Therefore, a wiring distance between the circuit board 32 and a component attached on the side of the handle portion 8 (e.g., battery board 47 and the like) can be shortened. Also, in the present embodiment, the main switch 36 is provided on an upper portion of the rear side of the body portion 7. The power supply wirings 38 are constructed by relatively thinker wirings, which are difficult to be bent with a small radius of curvature. Most of the power supply wirings 38 are connected to the main switch 36.

Figure 4:
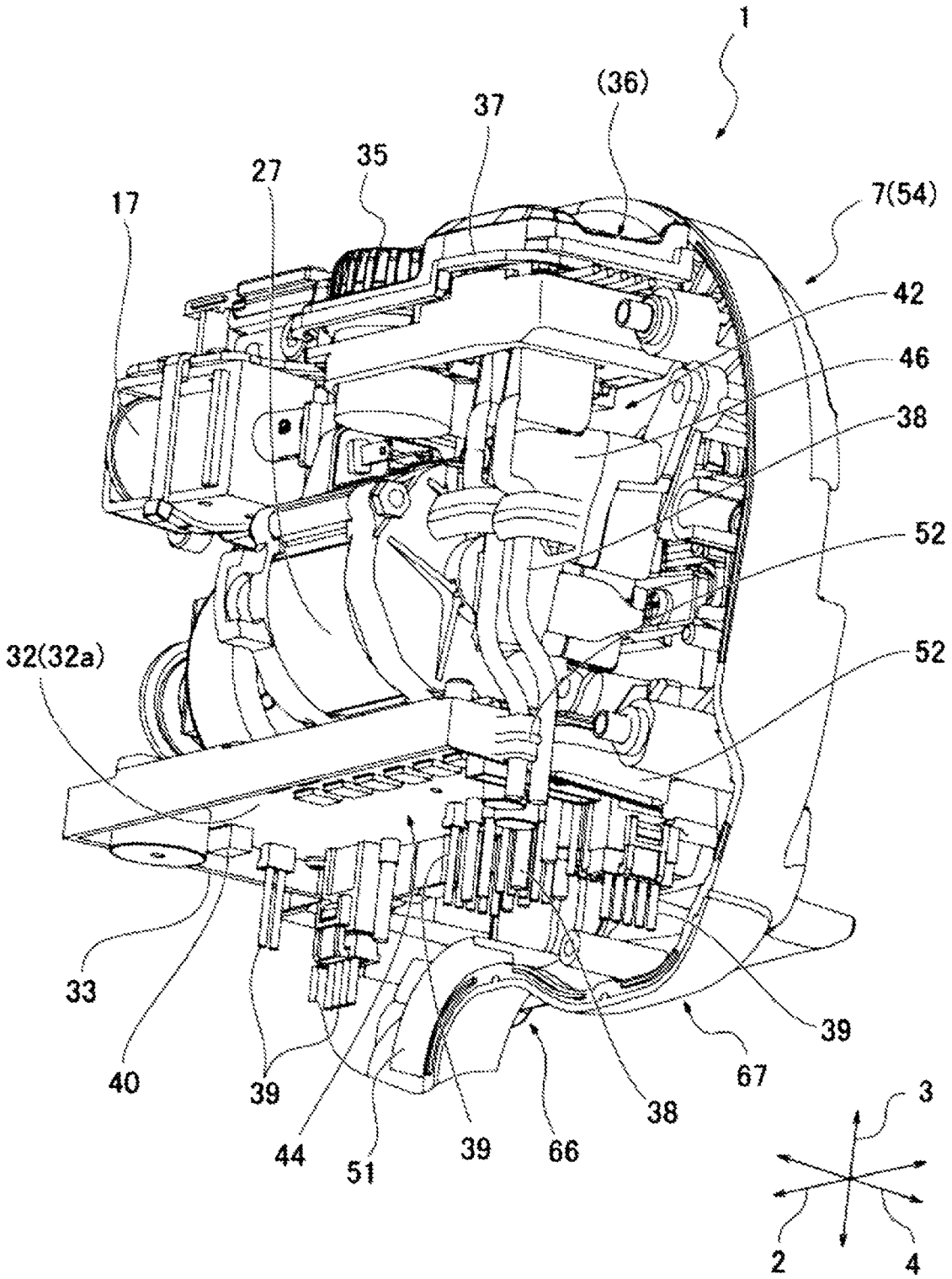
FIG. 4 is a partial perspective view showing an interior structure of a rear part of the binding machine in FIG. 1, as viewed obliquely from rear.

(3) As shown in FIG. 4, the power supply wirings 38 may be guided to the rear side of the body portion 7 after emerging from the mounting surface 32*a* of the circuit board 32, and also be arranged to extend through the rear space 42 over the end portion of the circuit board 32, which is located toward the rear space 42. The most of the signal wirings 39 are arranged in the front-side first region 43. The signal wirings 39 may be arranged at a location of the body portion 7, which is located toward the handle portion 8.

Herein, at least a part of the power supply wirings 38 are routed to extend through the rear side of the body portion 7. In order to rout the power supply wirings 38 on the rear side of the body portion 7, a wiring guide portion 51 (see FIG. 3) may be provided in a lower portion of the rear side of the body portion 7. The wiring guide portion 51 extends along the inner wall surface 34 of the body portion 7, which is located in the rear of the handle portion 8, to protrude with a desired width inside the body portion 7. Therefore, the wiring guide portion 51 guides wirings, such as the power supply wirings 38, rearward without poking out of the body portion 7 (first body portion 54 as described below). Also, on the rear end portion of the circuit board case 33, a single or a plurality of horizontal hook portions 52 and the like may be provided to cause wirings, such as the power supply wirings 38, which are guided rearward by the wiring guide portion 51, to collectively extend upward therethrough. Also, the signal wirings 39 are constructed by relatively flexible and thinner wirings, which are easy to be bent with a small radius of curvature. The side of the second region 44 may be the second region 44 itself and also may be a part of the first region 43, which is located close to the second region 44. The location, which is located toward the handle portion 8, may be a location directly opposing the handle portion 8, or may be a location, which is located more closer to the location opposing the handle portion 8 (than the power supply wirings 38).

Figure 2:
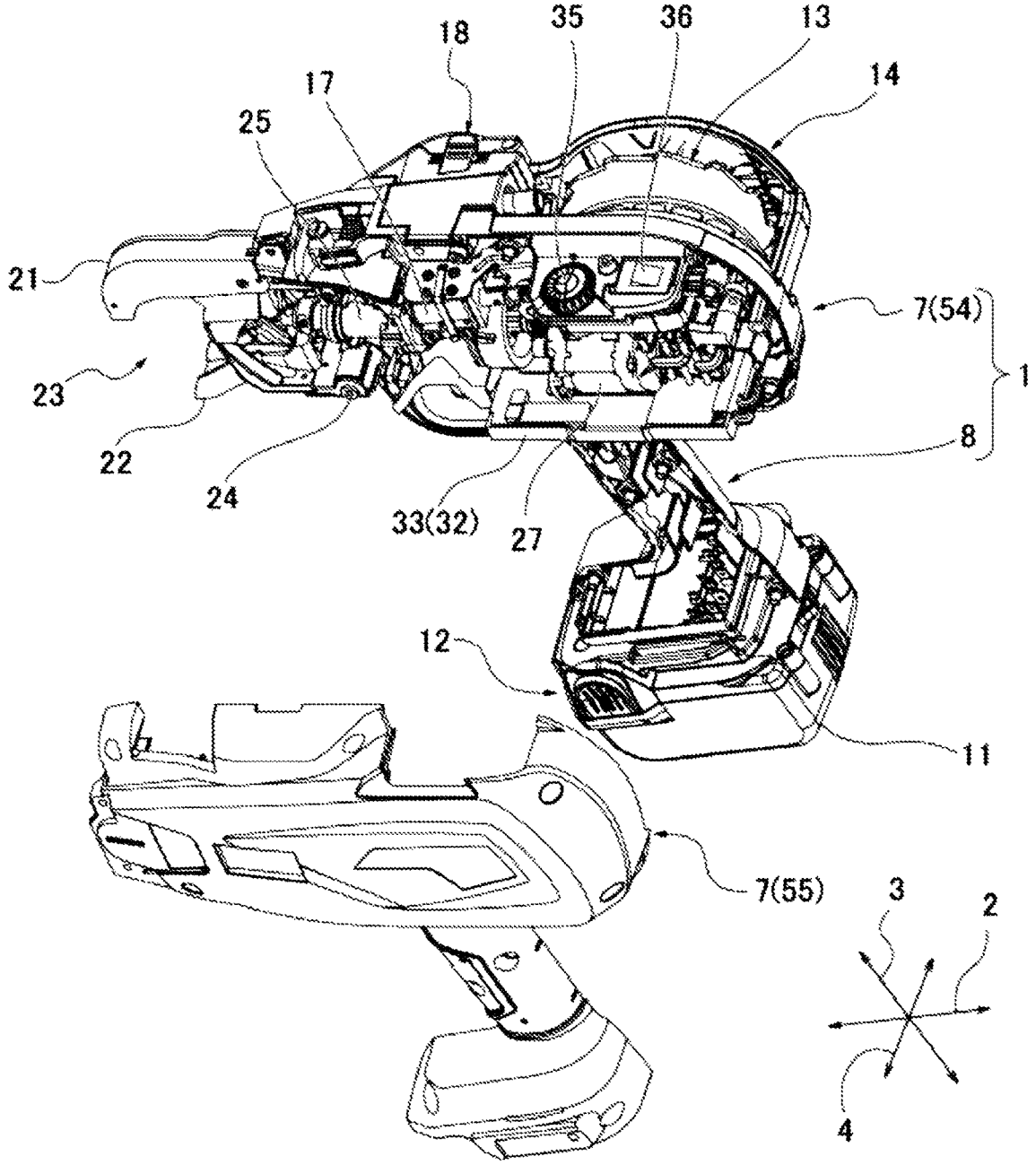
FIG. 2 is a perspective view showing a state where the binding machine is divided into a first body portion and a second body portion, as viewed obliquely from above.
Figure 3:
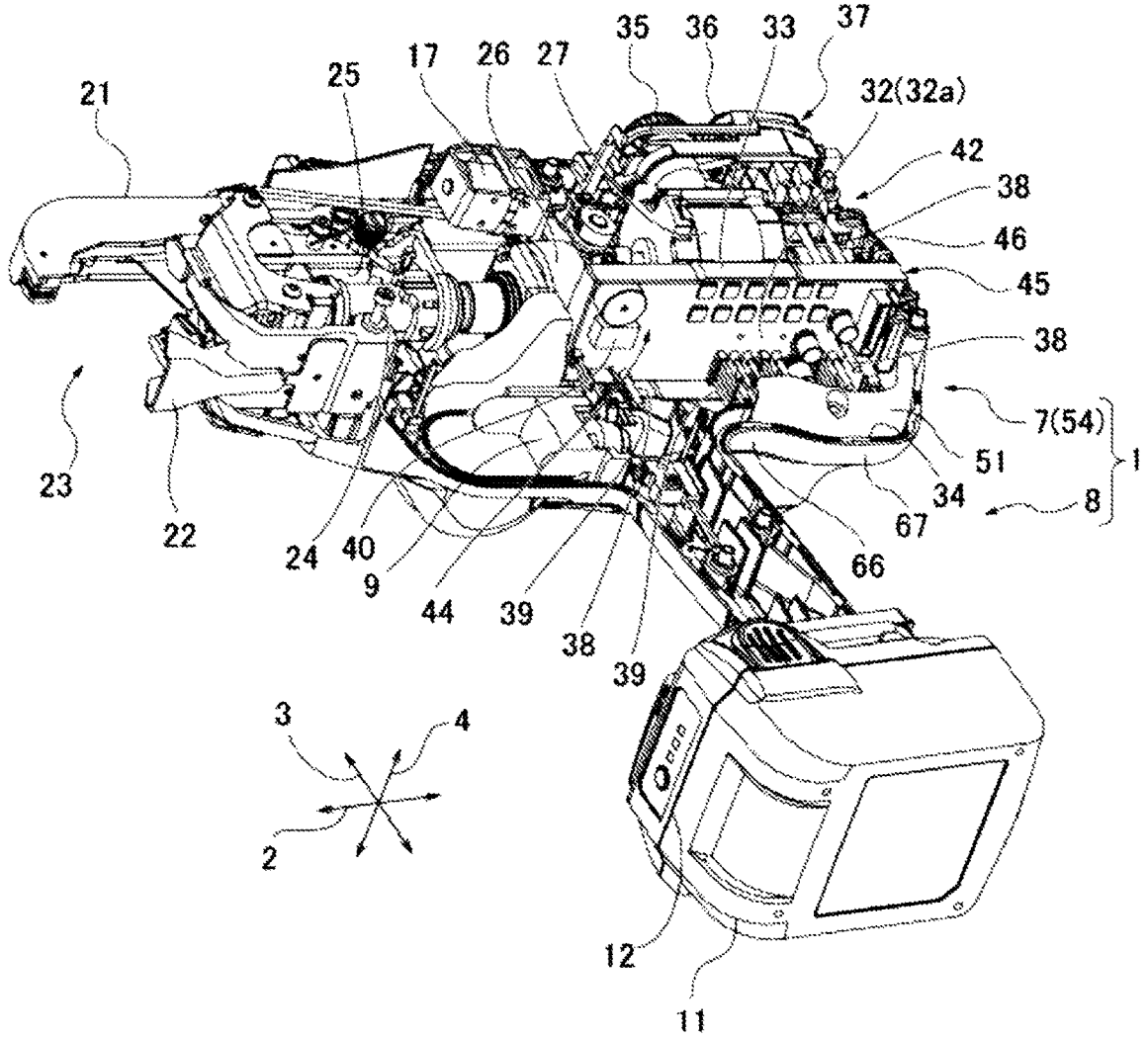
FIG. 3 is a perspective view of the binding machine in FIG. 1, as viewed obliquely from below.

(4) As shown in FIG. 2, the body portion 7 may be configured to be dividable into a first body portion 54 and a second body portion 55 in the widthwise direction (third direction 4). The circuit board 32 may be fixed to the first body portion 54. In the present embodiment, the circuit board 32 is fixed to the first body portion 54 via the circuit board case 33, and the circuit board case 33 is fixed to the first body portion 54 by fixing portions 56, such as screws (see FIG. 1).

Herein, the body portion 7 and the handle portion 8 are formed as an integral case, and various components, such as the twisting unit 25 and the circuit board 32, are housed therein. Then, the first body portion 54 serves as an attaching base allowing the above various components to be attached thereon. Also, the second body portion 55 serves as a cover configured to be attached on the first body portion 54 to cover the above various components. The first body portion 54 and the second body portion 55 are integrally fixed to each other by screws or the like while sandwiching the above various components from both sides in the third direction 4. Each fixing portion 56 has a boss portion formed to integrally protrude from an inner surface of a side wall of the first body portion 54, an attaching piece integrally provided at a location on the upper portion of the circuit board case 33, which opposes the boss portion, and a fixture, such as a screw, for fastening the attaching piece to the boss portion.

Figure 6:
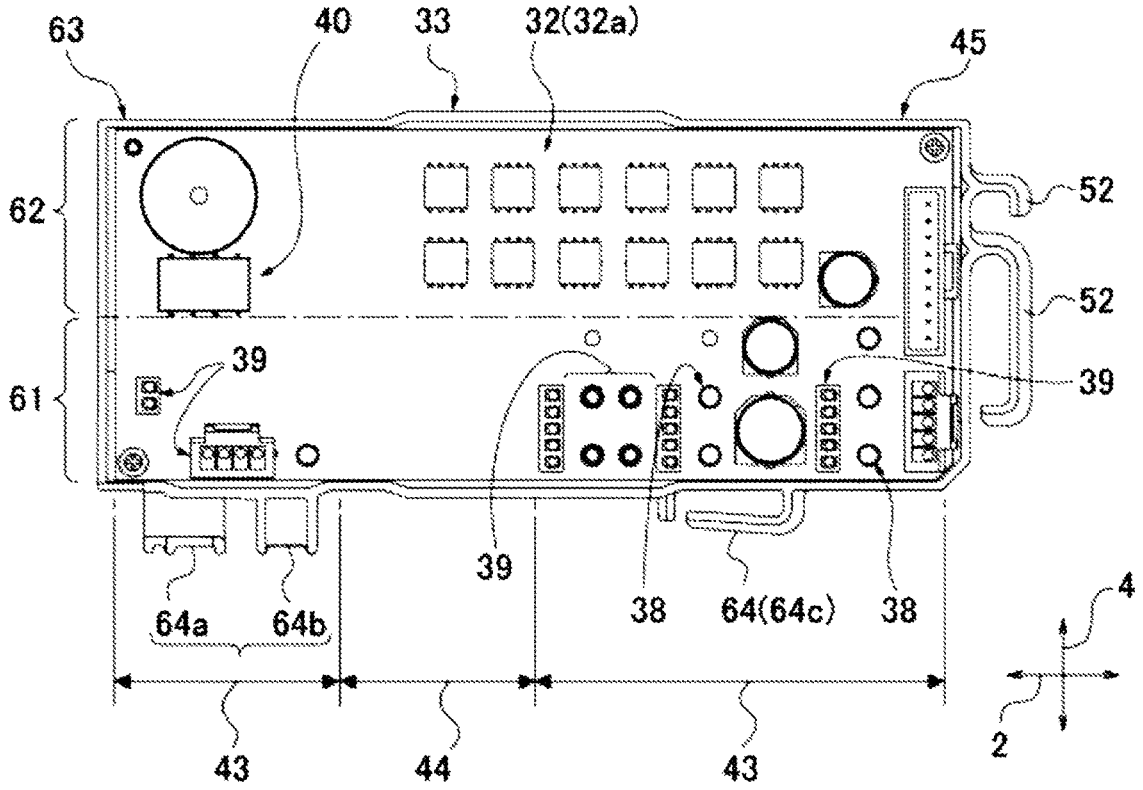
FIG. 6 is a view showing a mounting surface of the circuit board, as viewed from the side of a handle portion (from below).

(5) As shown in FIG. 6, a plurality of wirings (power supply wirings 38 and signal wirings 39) extending from the mounting surface 32*a* of the circuit board 32 may be concentratively arranged on a side thereof, which is located toward the first body portion 54.

Herein, it is assumed that the side of the circuit board 32, which is located toward the first body portion 54, means substantially a half region 61 of the circuit board 32, which is located toward the first body portion 54. On the other hand, substantially a half region 62 of the circuit board 32, which is located toward the second body portion 55, is referred to as a side of the circuit board 32, which is located toward the second body portion 55. Also, no or few wirings are arranged in the region 62 of the circuit board 32.

(6) As shown in FIG. 1, the circuit board case 33, in which the circuit board 32 is received, may extend to a location opposing the speed reduction mechanism 26 provided between the twisting unit 25 and the twist motor 27.

Herein, the circuit board case 33 is provided with a second extension portion 63 extending to the speed reduction mechanism 26 or further forward than the speed reduction mechanism 26. In the present embodiment, the second extension portion 63 extends to a position reaching a rear portion of the twisting unit 25. The circuit board 32 can be extended to the inside of the second extension portion 63. The first region 43 located on the front side as described above is provided on the side of the second extension portion 63.

Figure 7:
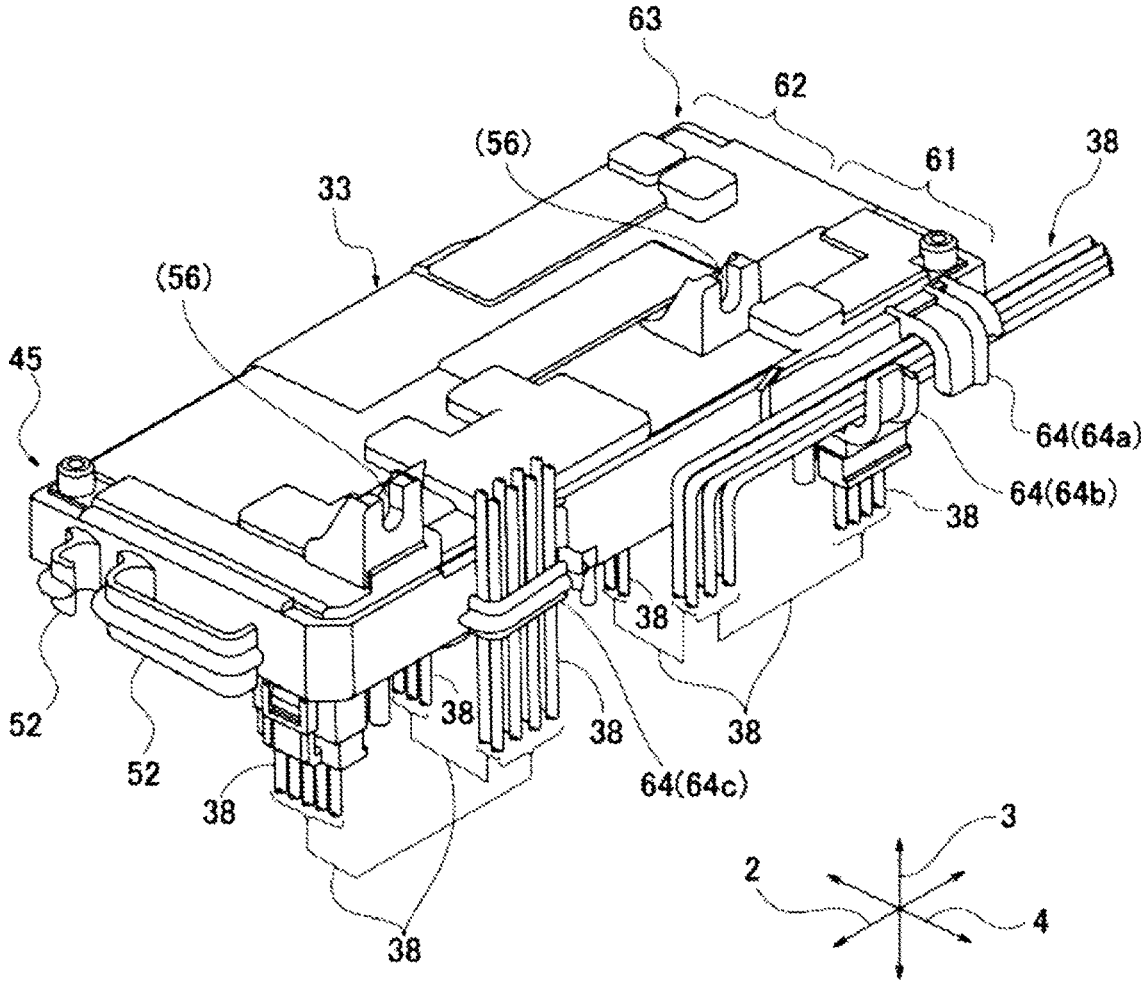
FIG. 7 is a perspective view of a circuit board case, as viewed obliquely from above.

(7) As shown in FIG. 7, a wiring holding portion 64 for holding a plurality of wirings extending from the mounting surface 32*a* may be provided on a side surface of the circuit board case 33, which opposes the first body portion 54.

Herein, the wiring holding portion 64 is configured to hold the wirings by allowing the wirings to extend therethrough, and is, for example, a locking portion, such as a hook, or a hole portion. Preferably, the wiring holding portion 64 can hold a plurality of wirings. In the present embodiment, wiring holding portions 64 are provided at least at two locations, which are respectively located on front and rear sides of the side surface of the circuit board case 33. For example, the front-side wiring holding portion 64 serves as a guide portion for holding wirings (power supply wirings 38 and the like), which emerge from the mounting surface 32*a* (lower surface) of the circuit board 32 and then extend toward the front side of the body portion 7, along the side surface of the circuit board case 33, which is located toward the first body portion 54. Therefore, the front-side wiring holding portion 64 has at least one of an upward hook portion 64*a* and a downward hook portion 64*b*. For example, the rear-side wiring holding portion 64 serves as a guide portion for holding wirings (power supply wirings 38 and the like), which emerge from the mounting surface 32*a* (lower surface) of the circuit board 32 and then extend upward and also toward the rear side of the body portion 7, along the side surface of the circuit board case 33. Therefore, the rear-side wiring holding portion 64 is formed as a forward hook portion 64*c*.

(8) As shown in FIG. 1, the body portion 7 may be provided with a recessed portion 66 opposite to the trigger switch 9 in the first direction 2 with respect to a side of the handle portion 8.

Herein, the recessed portion 66 is intended to displace a gripping position on the handle portion 8 toward the upper side of the body portion 7 (toward the circuit board 32). For example, the recessed portion 66 is not a part formed by slightly cutting out both sides of the lower portion of the body portion 7 to make it easy to grip the handle portion 8 (it is substantially impossible to change the gripping position), but is configured as a pit formed by scraping or cutting out the entire lower portion of the body portion 7. Therefore, the highest portion (deep portion) of the recessed portion 66 is higher than the lowest location on a rear bottom portion of the body portion 7, and a difference in height therebetween is, for example, about ½ to ⅓ of a vertical dimension of the trigger switch 9. The recessed portion 66 may be formed by recessing the rear bottom portion of the body portion 7 itself upward. Alternatively, a portion configured to be placed on the back of a worker's hand and thus to support a load (load supporting portion 67) may be provided to protrude from the rear bottom portion of the body portion 7, and the recessed portion 66 may be provided on the load supporting portion 67. In the present embodiment, a ridge extending forward toward the handle portion 8 is provided on the rear bottom portion of the body portion 7 and thus serves as the load supporting portion 67. The recessed portion 66 is provided by entirely recessing a part of a front side of the load supporting portion 67, which is located close to the handle portion 8, upward to conform to the hand.

(9) As shown in FIGS. 8 to 11, as another embodiment, the binding machine 1 may be configured as follows.

That is, in a state where as described above, the circuit board 32 is arranged on a side of the twist motor 27, which is located toward the handle portion 8 (inner wall surface 34), the setting unit 35 for setting operation conditions of the binding machine 1 may be arranged at a location, which is located more toward the handle portion 8 than the circuit board 32.

Figure 8:
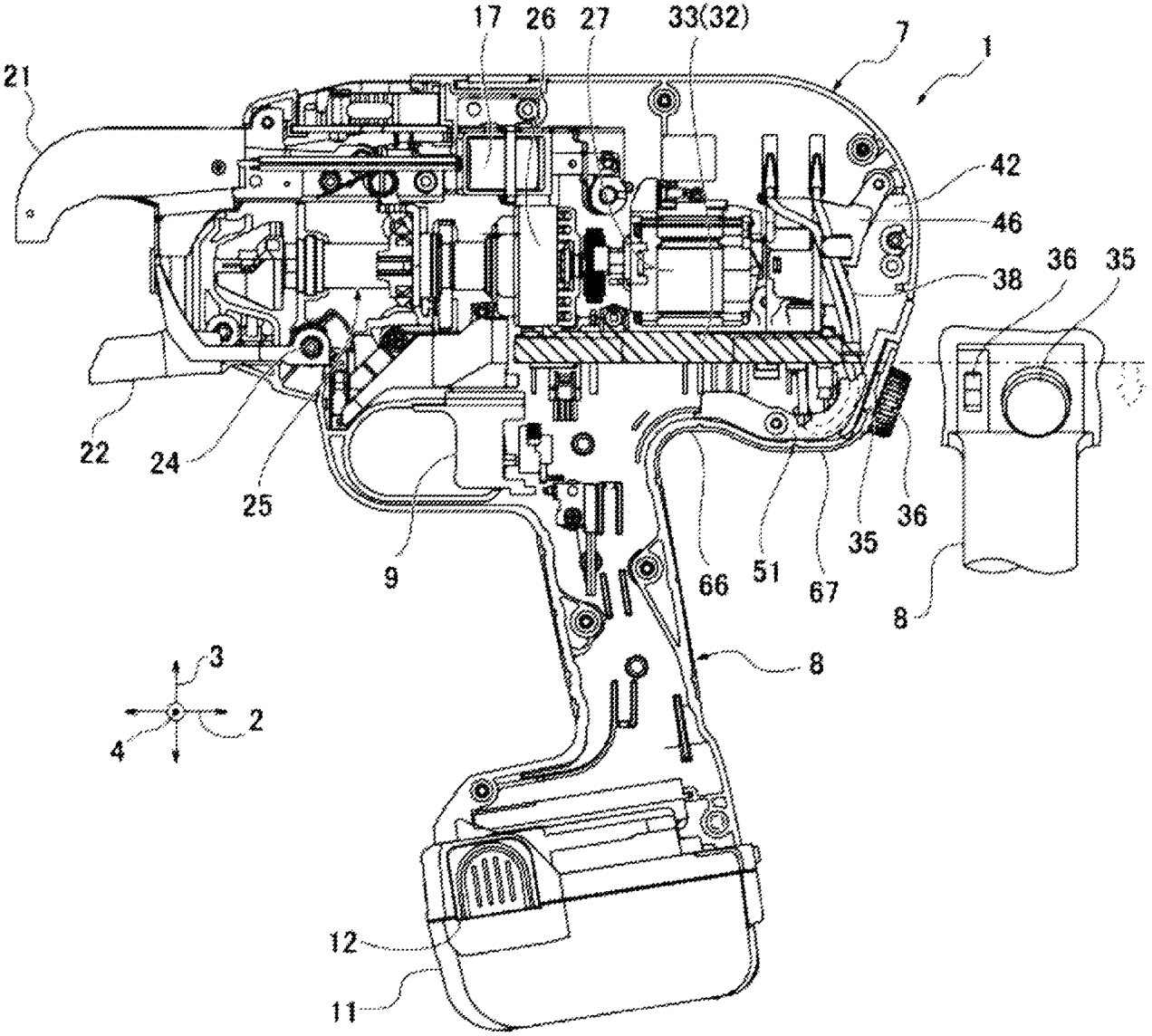
FIG. 8 is a view showing a binding machine having a setting unit different in installation position thereof, in which a partial enlarged view of the setting unit is added to a side view similar to FIG. 1.
Figure 9:
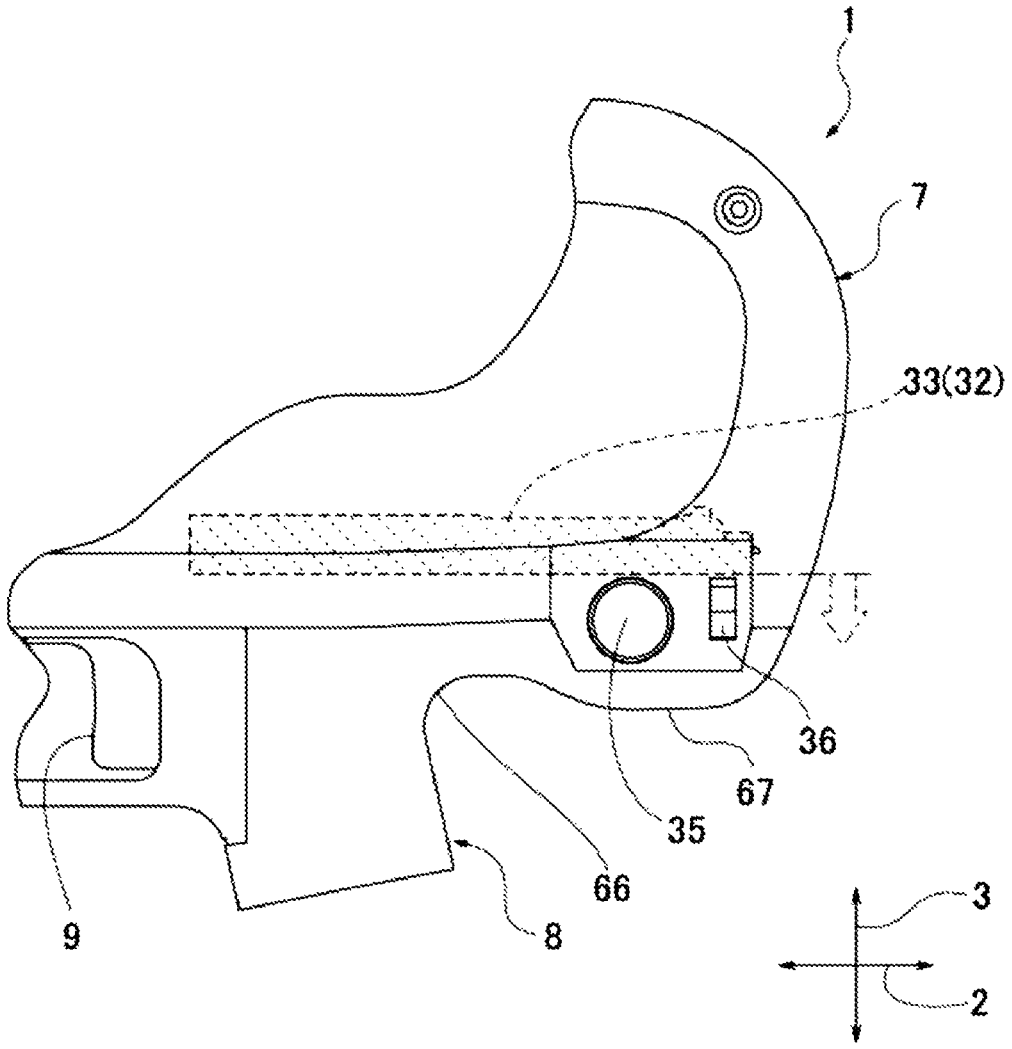
FIG. 9 is a partial enlarged view of a rear part of the binding machine, illustrating the variant of FIG. 8.
Figure 10:
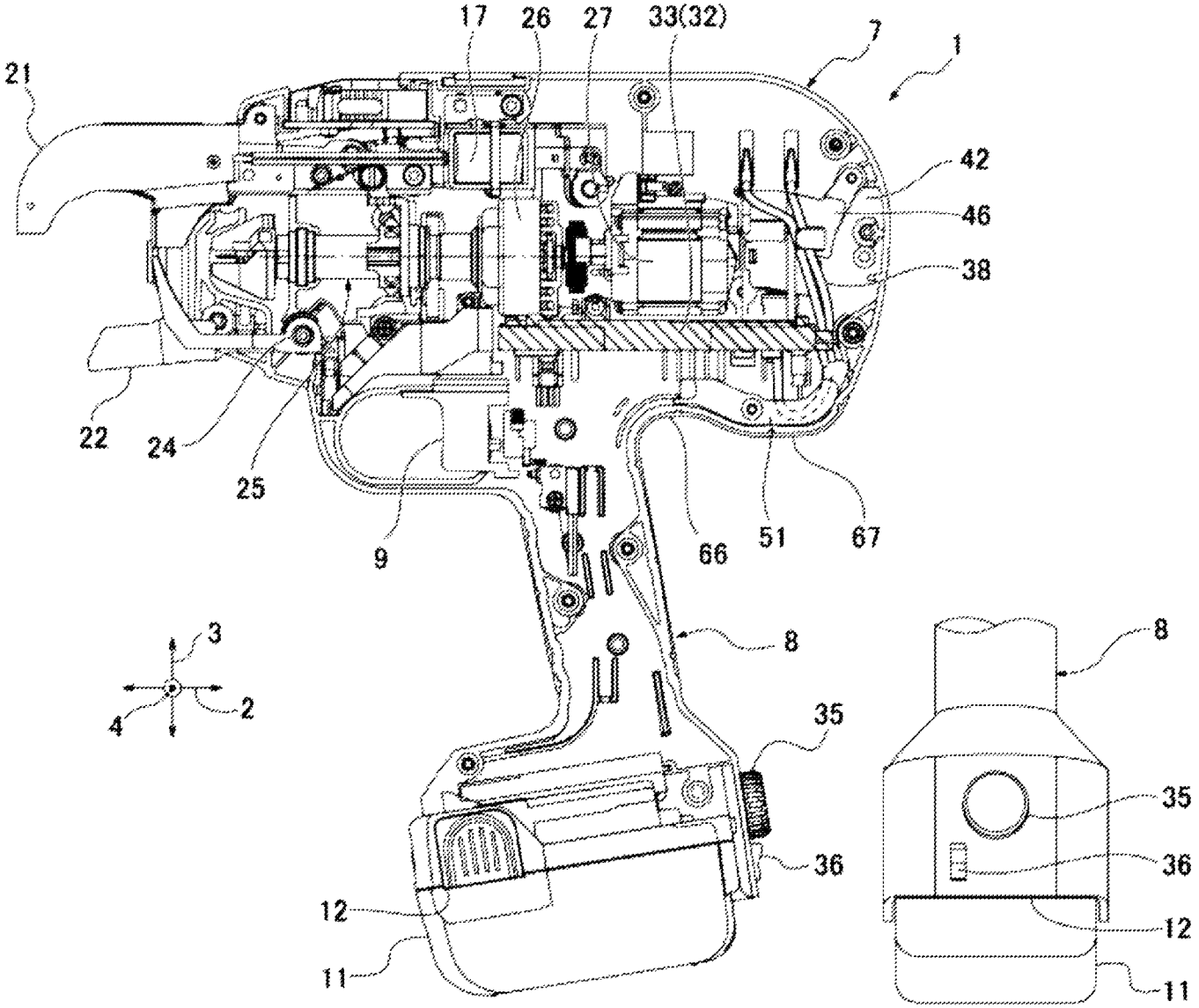
FIG. 10 is a view showing another binding machine having a setting unit different in installation position thereof, in which a partial enlarged view of the setting unit is added to a side view similar to FIG. 1.
Figure 11:
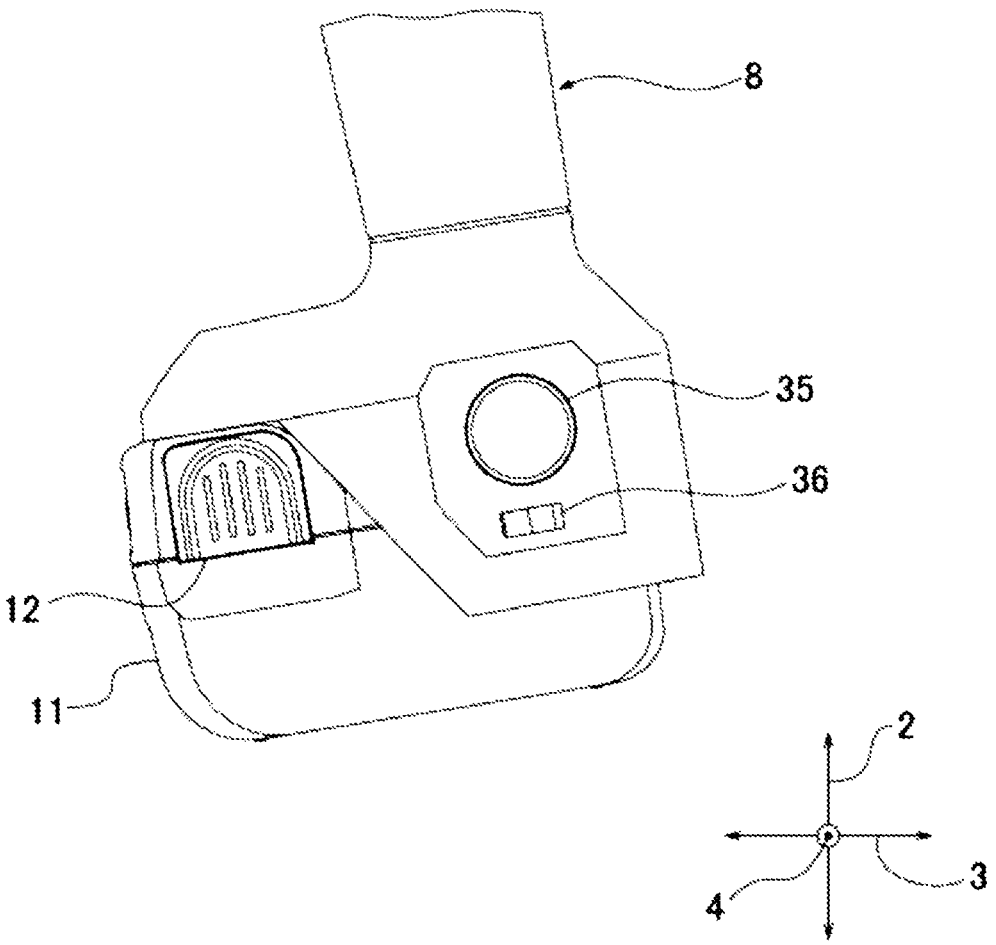
FIG. 11 is a partial enlarged view of a handle portion, illustrating the variant of FIG. 10.

Herein, the location, which is located more toward the handle portion 8 than the circuit board 32, may be set to a location on the lower portion of the body portion 7, which is located lower than a location at which the circuit board 32 is arranged, or to the handle portion 8. In the case where the location is set to the location on the lower portion of the body portion 7, for example, the setting unit 35 can be arranged on a lower side of the rear end portion of the body portion 7 as shown in FIG. 8 or can be arranged on a side surface of the rear side of the body portion 7 as shown in FIG. 9. Also, in the case where the location is set to the handle portion 8, for example, the setting unit 35 is preferably arranged at a location corresponding to a portion for attaching the battery 11 to the handle portion 8 (battery attaching portion 12) as shown in FIGS. 10 and 11. For example, the setting unit 35 can be arranged on a rear end portion of the battery attaching portion 12 as shown in FIG. 10 or can be arranged on a side surface portion of the battery attaching portion 12 as shown in FIG. 11.

<Operation>

Hereinafter, operation of the present embodiment will be described.

The reel 13 having the wire 6 wound thereon is mounted on the mount portion 14, and then the main switch 36 is turned on. In this state, the distal end of the body portion 7 is oriented toward reinforcing bars 5, the reinforcing bars 5 are inserted between the upper and lower curl guides 21, 22, and then the trigger switch 9 is pulled. As a result, the wire feeding unit 18 is activated so that the wire 6 is drawn out from the reel 13 and then is delivered to the front side of the body portion 7. The wire 6 delivered to the front side of the body portion 7 is curled by the curl guides 21, 22 and also guided to be wrapped in one turn or a plurality of turns around the reinforcing bars 5. Thereafter, the loop-shaped wire 6 wound around the reinforcing bars 5 is twisted by the twisting unit 25, so that a diameter of the loop is reduced, thereby binding the reinforcing bars 5. Since the binding machine 1 can be operated with one hand, usability is very good, but if the work is performed for a long time, a burden on a worker's arm increases. Therefore, in order to alleviate the burden on the worker's arm at least a little bit, a study for improving a weight balance of the binding machine 1 is always required. In order to improve the weight balance of the binding machine 1, it is effective to downsize the binding machine 1 and the like.

However, for example, the binding machine 1 has various driving units, such as the twist motor 27, and also has the circuit board 32, on which the control unit 40 for controlling various driving units and the like is mounted, and the like. Among them, the circuit board 32 had to be installed at a certain distance from the twist motor 27 in order to avoid influence of heat generated by the twist motor 27 and the like. Therefore, a required space had to be provided between the twist motor 27 and the circuit board 32, and the space made it difficult to downsize the binding machine 1.

<Effects>

According to the present embodiment, the following effects can be obtained.

(Effect 1)

The circuit board 32 is arranged such that the mounting surface 32*a* faces the inner wall surface 34, which is located toward the handle portion 8. Therefore, the mounting surface 32*a* of the circuit board 32 is not directly exposed to the heat generated by the twist motor 27. That is, the circuit board 32 is arranged to strongly resist the heat from the twist motor 27. As a result, it is possible to arrange the circuit board 32 to be correspondingly closer to the twist motor 27. Also, electronic components and the like having a height as on the mounting surface 32*a* are not present on the back surface (soldering surface) of the circuit board 32. Correspondingly, it is possible to arrange the circuit board 32 to be closer to the twist motor 27. Thanks to these measures, it is possible to downsize the binding machine 1.

In addition, since the circuit board 32 is arranged to be closer to the twist motor 27 than the inner wall surface 34, components, such as the twist motor 27 and the circuit board 32, can be concentratively arranged in the vicinity of the center of the inside of the body portion 7. Since components, such as the twist motor 27 and the circuit board 32, are concentratively arranged in the vicinity of the center of the inside of the body portion 7, the weight balance of the binding machine 1 can be improved. Further, since components, such as the twist motor 27 and the circuit board 32, are concentratively arranged in the vicinity of the center of the inside of the body portion 7, the handle portion 8 (and thus a gripping position thereon) can be provided to be closer to the upper side of the body portion 7 than the existing one. Correspondingly, a position of the middle finger when the handle portion 8 is gripped (a location in the vicinity of the lower end of the trigger switch 9) can be brought closer to the centroid position 68 of the binding machine 1 than before. Therefore, the weight balance of the binding machine 1 can be improved and also operability thereof can be enhanced. Meanwhile, the centroid position 68 of the binding machine 1 is determined by a weight of the body portion 7 and a weight of the battery 11 and generally corresponds to the position as shown in FIG. 1 and the like.

(Effect 2)

If at least a part of the circuit board 32 extends to a location opposing the handle portion 8 and also, for example, the power supply wirings 38 for the battery board 47 are arranged on the second extension portion 63 of the circuit board 32, the power supply wirings 38 can be generally straightly extended from the circuit board 32, thereby shortening a wiring distance from the circuit board 32 to the battery board 47.

(Effects 3 and 4)

The power supply wirings 38 extending from the mounting surface 32*a* of the circuit board 32 toward the main switch 36 are guided to the rear side of the body portion 7 after emerging from the mounting surface 32*a* of the circuit board 32, and also arranged to extend through the rear space 42 over the rear end portion of the circuit board 32. Therefore, it is possible to shorten a wiring distance from the circuit board 32 to the main switch 36. Also, the signal wirings 39, of which a wiring diameter is thinner than that of the power supply wirings 38, are provided on the front-side first region 43, so that the signal wirings 39 are positioned to be closer to the handle portion 8 (than the power supply wirings 38 toward the main switch 36). Therefore, a space can be secured between the second region 44 of the circuit board 32 and the inner wall surface 34 of the body portion 7, which is located toward the handle portion 8. As a result, the gripping position on the handle portion 8 relative to the body portion 7 can be further brought closer to the twist motor 27 (upper side). Thus, a position of the middle finger when the handle portion 8 is gripped (a location in the vicinity of the lower end of the trigger switch 9) can be further brought closer to the centroid position 68 of the binding machine 1. Accordingly, the weight balance of the binding machine 1 can be further improved and also the operability of the binding machine 1 can be further enhanced. Meanwhile, although in the present embodiment, the power supply wirings 38 and the signal wirings 39 are not provided in the second region 44 of the circuit board 32, the signal wirings 39, of which a wiring diameter is thinner than that of the power supply wirings 38, may be provided therein.

(Effect 5)

The circuit board 32 extends to a location opposing the speed reduction mechanism 26. Therefore, dust or debris, such as iron powder generated by the twisting unit 25 or the speed reduction mechanism 26, is blocked by the soldering surface of the circuit board 32, thereby preventing dust or debris from adhering to the mounting surface 32*a* or from passing through the handle portion 8 and then adhering to the battery board 47. Also, in the present embodiment, the circuit board 32 is received in the circuit board case 33 and thus the back side (upper surface) of the circuit board 32 serves as a dustproof member. As a result, it is possible to further suppress dust or debris from adhering to the mounting surface 32*a* and the like.

(Effects 6 and 7)

The body portion 7 is divided into the first body portion 54 and the second body portion 55 in the widthwise direction. The circuit board 32 may be fixed to the first body portion 54 (by the fixing portions 56). At this time, the circuit board 32 may be fixed to the first body portion 54 via the circuit board case 33 (by the fixing portions 56). Thus, since the circuit board case 33 is attached to the first body portion 54, the circuit board case 33 can be used as a reinforcing rib or reinforcing member for the first body portion 54. Therefore, it is possible to effectively reinforce the first body portion 54 or the body portion 7. Also, since the circuit board case 33 is fixed to the first body portion 54 by the fixing portions 56, it is possible to ensure and enhance assemblability of the circuit board 32 or wirings to the first body portion 54 or also maintainability thereof.

(Effect 8)

Wirings are concentratively arranged on a part of the circuit board 32, which is located toward the first body portion 54, and then the part of the circuit board 32, on which the wirings are concentratively arranged, is installed to the first body portion 54. As a result, the wirings are installed inside the first body portion 54 while fitting well therein, and also the wirings are difficult to poke out to the second body portion 55. Therefore, it is possible to enhance fitting of the wirings to the first body portion 54 or the body portion 7 or assemblability of the circuit board 32 to the first body portion 54 or the body portion 7.

(Effect 9)

The wiring holding portion 64 for holding wirings extending from the mounting surface 32*a* is provided on the side surface of the circuit board case 33, which opposes the first body portion 54. As a result, the circuit board case 33 can be fixed to the first body portion 54 in a state where the wirings are held by the wiring holding portion 64. Thus, the wirings held by the wiring holding portion 64 can be installed between the circuit board case 33 and the first body portion 54 while fitting well therebetween. Therefore, the wirings can be easily installed and fixed between the circuit board case 33 and the first body portion 54.

(Effect 10)

The recessed portion 66 is provided at a location on the body portion 7, which is located in the rear of the handle portion 8, i.e., at a location on a side of the handle portion 8 opposite to the trigger switch 9. As a result, the back of a hand can be inserted into the recessed portion 66, and thus a gripping position on the handle portion 8 can be further brought closer to the twist motor 27 (upper side). Therefore, a position of the middle finger when the handle portion 8 is gripped (a location in the vicinity of the lower end of the trigger switch 9) can be further brought closer to the centroid position 68 of the binding machine 1. Accordingly, the weight balance of the binding machine 1 can be further improved and also the operability of the binding machine 1 can be further enhanced. Also, the recessed portion 66 provided at the location on the body portion 7, which is located in the rear of the handle portion 8, is provided within a range, in which, when the handle portion 8 is gripped, the recessed portion 66 allows the body portion 7 to be placed on the back of a hand and thus can support a load. Therefore, the load of the body portion 7 can be supported in a state where the lower portion of the body portion 7 is placed in close contact with the back of the hand inserted in the recessed portion 66. Accordingly, the handle portion 8 can be stably gripped.

(Effect 11)

The setting unit 35 for setting operation conditions of the binding machine 1 may be arranged lower than the circuit board 32. Therefore, a distance from the circuit board 32 to the setting unit 35 can be shortened, thereby facilitating routing of wirings, connectors provided on the wirings and the like. Also, since the setting unit 35 is arranged lower than the circuit board 32, visibility of the setting unit 35 during a work can be improved. At this time, in a state where the circuit board 32 is arranged on a side of the twist motor 27, which is located toward the handle portion 8, the setting unit 35 may be arranged on a rear side of the body portion 7, which is located lower than the circuit board 32. Therefore, a distance between the circuit board 32 and the setting unit 35 can be shortened, thereby facilitating routing of wirings or connectors. Also, visibility of the setting unit 35 can be improved.

Alternatively, in a state where the circuit board 32 is arranged on a side of the twist motor 27, which is located toward the handle portion 8, the setting unit 35 may be arranged on a lower portion of a side surface of the rear end side of the body portion 7. Therefore, a distance between the circuit board 32 and the setting unit 35 can be shortened, thereby facilitating routing of wirings or connectors. Also, visibility of the setting unit 35 can be improved. Further, the setting unit 35 may be arranged at a location on the distal end portion of the handle portion 8, which corresponds to the battery attaching portion 12. Therefore, distribution in routing of wirings or connectors can be realized using the inner space of the handle portion 8 can be realized. Thus, it is possible to prevent receiving spaces for wirings or connectors (wiring receiving portion 46 and the like as described above) from being concentrated on the body portion 7, and also to facilitate maintenance of the body portion 7. Also, visibility of the setting unit 35 can be improved.

1: Binding machine 2: First direction (horizontal direction) 3: Second direction (vertical direction) 4: Third direction (widthwise direction) 5: Reinforcing bar (object) 6: Wire (binding member) 7: Body portion 8: Handle portion 25: Twisting unit 26: Speed reduction mechanism 27: Twist motor

32: Circuit board 32*a*: Mounting surface 33: Circuit board case 34: Inner wall surface 35: Setting unit 36: Main switch 38: Power supply wiring (wiring) 39: Signal wiring (wiring) 40: Control unit 42: Rear space 43: First region 44: Second region 45: First extension portion 54: First body portion 55:

Second body portion 56: Fixing portion 63: Second extension portion 64: Wiring holding portion 66: Recessed portion

The invention claimed is:

1. A binding machine comprising:

a twisting unit;

a twist motor configured to drive the twisting unit;

a circuit board case;

a circuit board having a mounting surface on which a control unit configured to control the twist motor is mounted, the circuit board positioned within the circuit board case;

a body portion housing the twisting unit, the twist motor and the circuit board, the body portion including an inner wall surface; and a handle portion protruding outward from the body portion, wherein the circuit board is arranged between the twist motor and the inner wall surface of the body portion, the circuit board being located toward the handle portion in such a manner that the mounting surface faces the inner wall surface and the circuit board is closer to the twist motor than the inner wall surface;

wherein the circuit board extends between a front end and a rear end, the front end of the circuit board extends no further than a front end of a junction between the handle portion and the body portion, and the rear end of the circuit board is located further rearward than a position of a rear end portion of the twist motor, wherein the circuit board has an extending part which extends to a rear space located on a side opposite to the twisting unit with respect to the twist motor, wherein a power supply wiring to a main switch for turning on and off a power supply is provided on the extending part of the circuit board, wherein the power supply wiring is arranged to extend from the extending part of the circuit board over an end portion of the circuit board, which is located toward the rear space, and then through the rear space, and wherein the binding machine further includes a wiring guide portion, the wiring guide portion including a protrusion and first and second ends, wherein the wiring guide portion extends along the inner wall surface of the body portion, wherein the protrusion of the wiring guide portion protrudes toward an inside of the body portion along the inner wall surface of the body portion, wherein the wiring guide portion is located below the circuit board case at a position that is rear of the handle portion, wherein the wiring guide portion is spaced apart from the circuit board case, wherein the wiring guide portion guides the power supply wiring in a rearward direction without protrusion of the power supply wiring out of the body portion, and wherein (i) the first end of the wiring guide portion receives the power supply wiring from the handle portion and (ii) the second end of the wiring guide portion guides the power supply wiring toward the rear space.

2. The binding machine according to claim 1, wherein at least a part of the circuit board is provided at a location opposing the handle portion.

3. The binding machine according to claim 1, wherein the twisting unit is connected to the twist motor via a speed reduction mechanism, and wherein the circuit board extends to a location opposing the speed reduction mechanism.

4. The binding machine according to claim 1, wherein the body portion is configured to be dividable into a first body portion and a second body portion in a widthwise direction, and wherein the circuit board is fixed to the first body portion.

5. The binding machine according to claim 4, wherein the circuit board is fixed to the first body portion via the circuit board case.

6. The binding machine according to claim 4, wherein the circuit board is configured to allow a plurality of wirings extending from the mounting surface to be concentratively arranged on a side thereof which is located toward the first body portion.

7. The binding machine according to claim 5, wherein a wiring holding portion is provided on a side surface of the circuit board case which opposes the first body portion, the wiring holding portion holds a wiring, and the wiring extends from the mounting surface.

8. The binding machine according to claim 1, wherein the handle portion has a trigger switch on a base end portion thereof, and wherein the body portion is provided with a recessed portion opposite to the trigger switch with respect to the handle portion.

9. The binding machine according to claim 1 further comprising a setting unit configured to set operation conditions of the binding machine, wherein the setting unit is arranged at a location on the body portion, which is located closer to the handle portion than the circuit board is to the handle portion.

10. The binding machine according to claim 1, wherein the front end of the circuit board extends no further than a rear portion of the twisting unit.

11. The binding machine according to claim 1, wherein the circuit board includes (i) a first region that includes the power supply wiring, and (ii) a second region that does not include the power supply wiring, wherein the extending part extends from the first region to the rear space.

12. The binding machine according to claim 5, wherein a rear portion of the circuit board case opposing the rear space includes one or more hooks configured to receive the power supply wiring from the second end of the wiring guide portion.

* * * * *